US006636611B2

(12) United States Patent
Kim et al.

(10) Patent No.: US 6,636,611 B2
(45) Date of Patent: Oct. 21, 2003

(54) COMBINED RECEIVER AND SPEAKER

(75) Inventors: Bok-Beum Kim, Suwon (KR); Man-Dae Han, Suwon (KR)

(73) Assignee: Samsung Electro-Mechanics Co., Ltd., Kyunggi-do (KR)

( * ) Notice: Subject to any disclaimer, the term of this patent is extended or adjusted under 35 U.S.C. 154(b) by 65 days.

(21) Appl. No.: 10/044,932

(22) Filed: Jan. 15, 2002

(65) Prior Publication Data

US 2003/0095680 A1 May 22, 2003

(30) Foreign Application Priority Data

Nov. 16, 2001 (KR) ..... 2001-0071503

(51) Int. Cl.[7] ..... H04R 25/00
(52) U.S. Cl. ..... 381/409; 381/402
(58) Field of Search ..... 381/409, 410, 381/406, 400, 402, 89, 55, 104, 96, 185

(56) References Cited

U.S. PATENT DOCUMENTS 4,712,247 A * 12/1987 Swarte

FOREIGN PATENT DOCUMENTS

JP 3-13100 * 1/1991

* cited by examiner

*Primary Examiner*—Sinh Tran
(74) *Attorney, Agent, or Firm*—Morgan, Lewis & Bockius LLP

(57) ABSTRACT

Disclosed herein is a combined receiver and speaker. The combined receiver and speaker has a diaphragm, a voice coil, and a chip resistor. The diaphragm generates sounds of a predetermined frequency through vibrations caused by a sound pressure in speaker and receiver modes. The voice coil vibrates the diaphragm using a magnetic field formed around a magnet attached to the diaphragm and generated by applied voice current. The chip resistor decreases the intensity of the applied voice current. The voice current is selectively applied to the voice coil such that the voice current is applied to the voice coil from speaker terminals in speaker mode, while the voice current is applied to the voice coil via the chip resistor from receiver terminals in receiver mode.

4 Claims, 4 Drawing Sheets

COMBINED RECEIVER AND SPEAKER

BACKGROUND OF THE INVENTION

1. Field of the Invention

The present invention relates generally to a combined receiver and speaker, in which the receiver and the speaker are combined into one structure, more particularly to a combined receiver and speaker, in which a speaker mounted on various kinds of mobile communication terminals such as mobile telephones including cellular phones, Personal Communication Service (PCS) phones, Personal Digital Assistants (PDA), International Mobile telecommunications (IMT)-2000 terminals and others and used for generating incoming sounds is combined with a receiver used for regenerating voice signals.

2. Description of the Prior Art

Generally, a speaker and a receiver included in a mobile communication terminal are equal to each other in terms of mechanical and electromagnetic structure. The speaker and the receiver are both designed to transduce electrical energy into mechanical energy by a voice coil in an air gap according to Fleming's left hand rule stating that magnetic force is exerted on a conductor when the conductor through which current flows is in a magnetic field.

In other words, when a current signal including a variety of frequencies is applied to the voice coil, the voice coil generates mechanical energy according to current intensity and frequency level, and then a diaphragm attached to the voice coil is vibrated, such that a sound pressure of audible intensity is generated.

The receiver denotes a device usually generating a relatively low sound pressure among sound pressures and typically used while being in contact with the ears in use. Contrary to the receiver, the speaker denotes a device generating a relatively high sound pressure and typically used while being placed away from the ears in use.

Magnetic circuits of the speaker and the receiver are each designed such that a magnetic flux crosses the voice coil existing in the air gap at a right angle by using a magnet and an upper plate in a yoke made of iron, and the voice coil is attached to the diaphragm. Therefore, the voice coil generates exciting force by an input signal, thus allowing the diaphragm fixedly attached to a frame to vibrate so as to generate a sound pressure. The diaphragm has one of various wave shapes so as to obtain excellent response characteristics and remove a buckling phenomenon when it vibrates up and down, and the shape of this diaphragm functions as a design variable greatly affecting frequency characteristics.

The speaker and receiver have not been remarkably modified in structure for a long time. However, recently, the miniaturization, lightening and high efficiency of speakers and receivers are constantly implemented according to the commercialization of high energy permanence magnets, the development of microstructure shaping technology, and the trend toward miniaturization and lightening in data communication fields.

Especially, it is not too much to say that the miniaturization of a mobile communication terminal depends on whether or not the parts such as a receiver, speaker, buzzer or oscillator having mechanical dynamic characteristics can be miniaturized. Therefore, research and development for combining such mechanical parts have been actively performed.

Mostly, conventional mobile communication terminals have each long used a buzzer for generating call sounds.

However, because a user demands the generation of various call sounds according to the user's convenience and preference, the conventional buzzer has been replaced with a speaker having excellent frequency characteristics. Further, in the receiver, the improvement of frequency characteristics together with the miniaturization and lightening has become an important issue.

A conventional speaker and a receiver are mounted at different positions as separate parts when they are mounted on a mobile communication terminal.

A sectional view of FIG. 1 shows that in a conventional combined receiver and speaker, that outputs the sound signals and call sounds of the mobile communication terminal, in which a voice coil 5 with an impedance of 80Ω and an impedance coil (HAC coil) 6 with an impedance of 32Ω are mounted on a diaphragm 4 as separate parts.

In order to drive the diaphragm 4, voice current is outputted through lines respectively connected to the voice coil 5 and the impedance coil 6 in receiver and speaker modes, such that the diaphragm 4 can be driven in corresponding mode. In other words, exciting force generated by attraction force and repulsive force between a magnetic field due to the voice current flowing through the voice coil 5 or the impedance coil 6 and a magnetic field of the magnet 2 mounted on a frame 1 allows the diaphragm 4 fixedly mounted on the frame 1 to vibrate so as to generate a sound pressure.

Further, FIG. 2 is another sectional view showing a combined receiver and speaker, which is designed to implement receiver and speaker functions in different directions. Referring to FIG. 2, a diaphragm 14 for a receiver is arranged over a magnet 12 and an upper plate 13 mounted on a double yoke 11 in a frame 10, and a first voice coil 15 is mounted at a portion of the diaphragm 14. In addition, a diaphragm 16 for a speaker is arranged at the left side of the double yoke 11, and a second voice coil 17 is mounted on the diaphragm 16 to be inserted into the double yoke 11. In such a structure, the respective diaphragms 14 and 16 are arranged in different directions, such that they are driven by voice currents applied to the voice coils 15 and 17, respectively.

Therefore, the first conventional combined receiver and speaker, in which the voice coil and the impedance coil Mare arranged on one diaphragm, is problematic in that it is inconvenient to simultaneously mount the voice coil of 80Ω and the impedance coil of 32Ω, and is decreased in its productivity and operation efficiency due to the difficult wiring process of the voice and impedance coils.

On the other hand, the second conventional combined receiver and speaker, in which the receiver and speaker functions are implemented in different directions, is problematic in that, because a double yoke must be additionally mounted on the frame and is constructed in opposite directions to arrange the voice coils of 80Ω and 32Ω at separate diaphragms so as to control impedance, it is difficult to miniaturize and integrate the receiver and speaker due to the limited space, and increases production costs because of more parts needed. Especially, in a speaker for generating call sounds, a diaphragm having a diameter comparatively larger than that of a receiver is required to output a sound pressure with a proper level, such that the combined receiver and speaker causes problems in its miniaturization.

As described above, in the conventional combined receiver and speaker, a voice coil for driving the diaphragm is mounted as a separate part to control impedance, such that an impedance control using the voice coil is difficult, causes a high failure rate, and increases costs.

SUMMARY OF THE INVENTION

Accordingly, the present invention has been made keeping in mind the above problems occurring in the prior art, and an object of the present invention is to provide a combined receiver and speaker, in which voice current is applied only to a voice coil in a speaker mode, while applied to both the voice coil and a chip resistor in a receiver mode, thus more effectively controlling impedance and easily achieving miniaturization and integration of the receiver and the speaker.

Another object of the present invention is to provide a combined receiver and speaker, which is constructed to arrange a single voice coil and a chip resistor in series so that the single voice coil is mounted at a portion of a diaphragm and the chip resistor is mounted at a portion of a frame, such that single directional and bi-directional speaker and receiver modes can be simultaneously operated, and only a bi-directional speaker mode can be operated, thus reducing the manufacturing costs and simplifying the operation process of the receiver combined with the speaker.

In order to accomplish the above object, the present invention provides a combined receiver and speaker comprising a diaphragm for generating sounds of a predetermined frequency through vibrations caused by a sound pressure in speaker and receiver modes; a voice coil for vibrating the diaphragm using a magnetic field formed around a magnet attached to the diaphragm and generated by applied voice current; and a chip resistor for decreasing the intensity of the applied voice current; wherein the voice current is selectively applied to the voice coil such that the voice current is applied to the voice coil from speaker terminals in speaker mode, while the voice current is applied to the voice coil via the chip resistor from receiver terminals in receiver mode.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
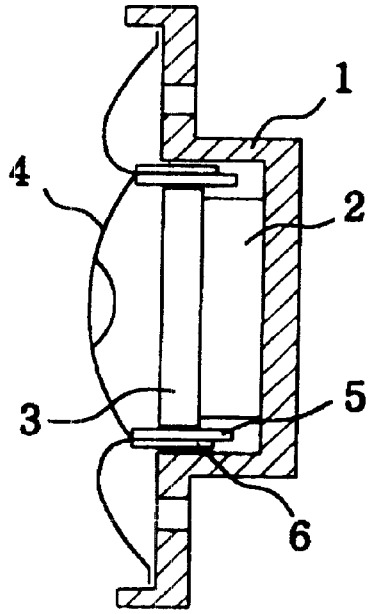
FIGS. 1 and 2 are sectional views each showing a conventional combined receiver and speaker.
Figure 2:
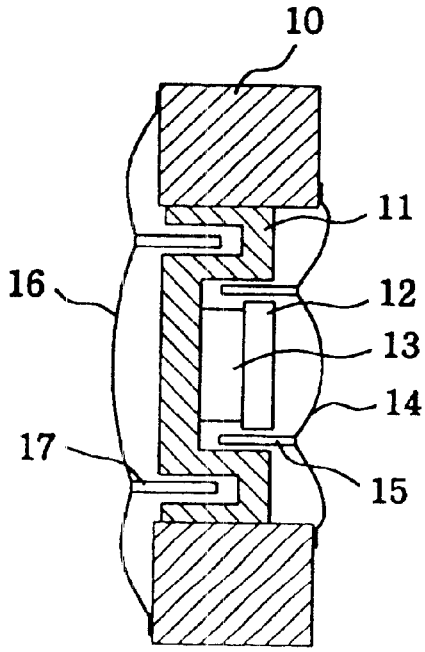
Figure 3:
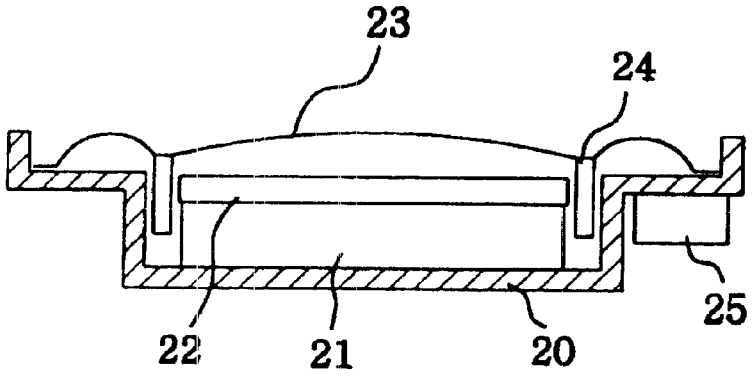
FIG. 3 is a sectional view showing a combined receiver and speaker according to a preferred embodiment of the present invention.
Figure 4:
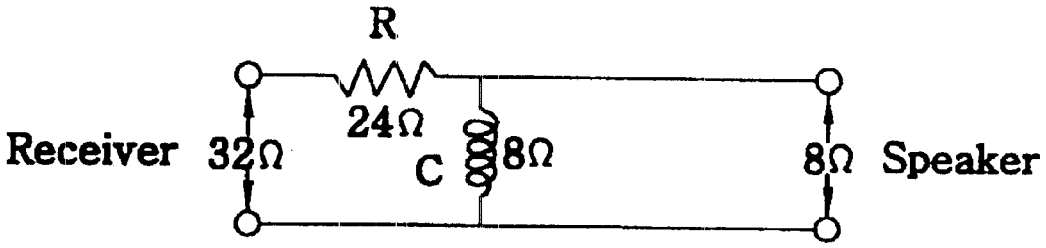
FIG. 4 is a circuit diagram of the combined receiver and speaker of this invention.

FIG. 3 is a sectional view showing a combined receiver and speaker of this invention, and FIG. 4 is a circuit diagram of the combined receiver and speaker of this invention.

In the combined receiver and speaker of this invention, the combined receiver and speaker functions as a speaker to input/output voice signals in speaker mode, and as a receiver to input/output voice signals in receiver mode. The combined receiver and speaker is enclosed in a frame 20.

In other words, the combined receiver and speaker is designed to allow a magnet 21 and an upper plate 22 to be mounted within the frame 20.

A permanent magnet is preferably employed as the magnet 21, and an inherent magnetic flux from the magnet 21 is formed in a predetermined direction The upper plate 22 is mounted on the upper surface of the magnet 21.

Further, in the combined receiver and speaker, a diaphragm 23 for generating a sound with a predetermined frequency using vibrations caused by sound pressures generated in speaker and receiver modes is mounted over the frame 22 to cover the magnet 21 and the upper plate 22. A circular thin film diaphragm is preferably adopted as the diaphragm 23.

A voice coil 24 generates a sound pressure by vibrating the diaphragm 23 up and down using a magnetic field formed around the magnet 21 arranged under the diaphragm 23 and formed by an applied voice current. The voice coil 24 is preferably set to a predetermined impedance for outputting a sound pressure required in the speaker mode, for example, a resistance value of 8Ω.

Further, a chip resistor 25 for decreasing the applied voice current is arranged at a portion of the frame 20, such that the chip resistor 25 and the voice coil 24 are connected in series in the receiver mode, thus decreasing the voice current using fan impedance value obtained by summing the impedances of the chip resistor 25 and the voice coil 24. Here, the chip resistor 25 is preferably set to at predetermined impedance for outputting a required sound pressure in the receiver mode, for example, a resistance value of 24Ω. Accordingly, the total impedance is set as a resistance value of 32Ω in the receiver mode by summing the resistance values of the voice coil 24 and the chip resistor 25.

Referring to the circuit diagram shown in FIG. 3, an equivalent resistor R for the chip resistor 25 and an equivalent coil C for the voice coil 24 are connected in series.

As described above, the voice current is applied to the coil C from speaker terminals Sa and Sb in the speaker mode, while the voice current is applied to the coil C from receiver terminals Ra and Rb via the resistor R in the receiver mode.

The operation of the combined receiver and speaker, which has the above construction, is described in detail with reference to FIG. 5.

Figure 5A:
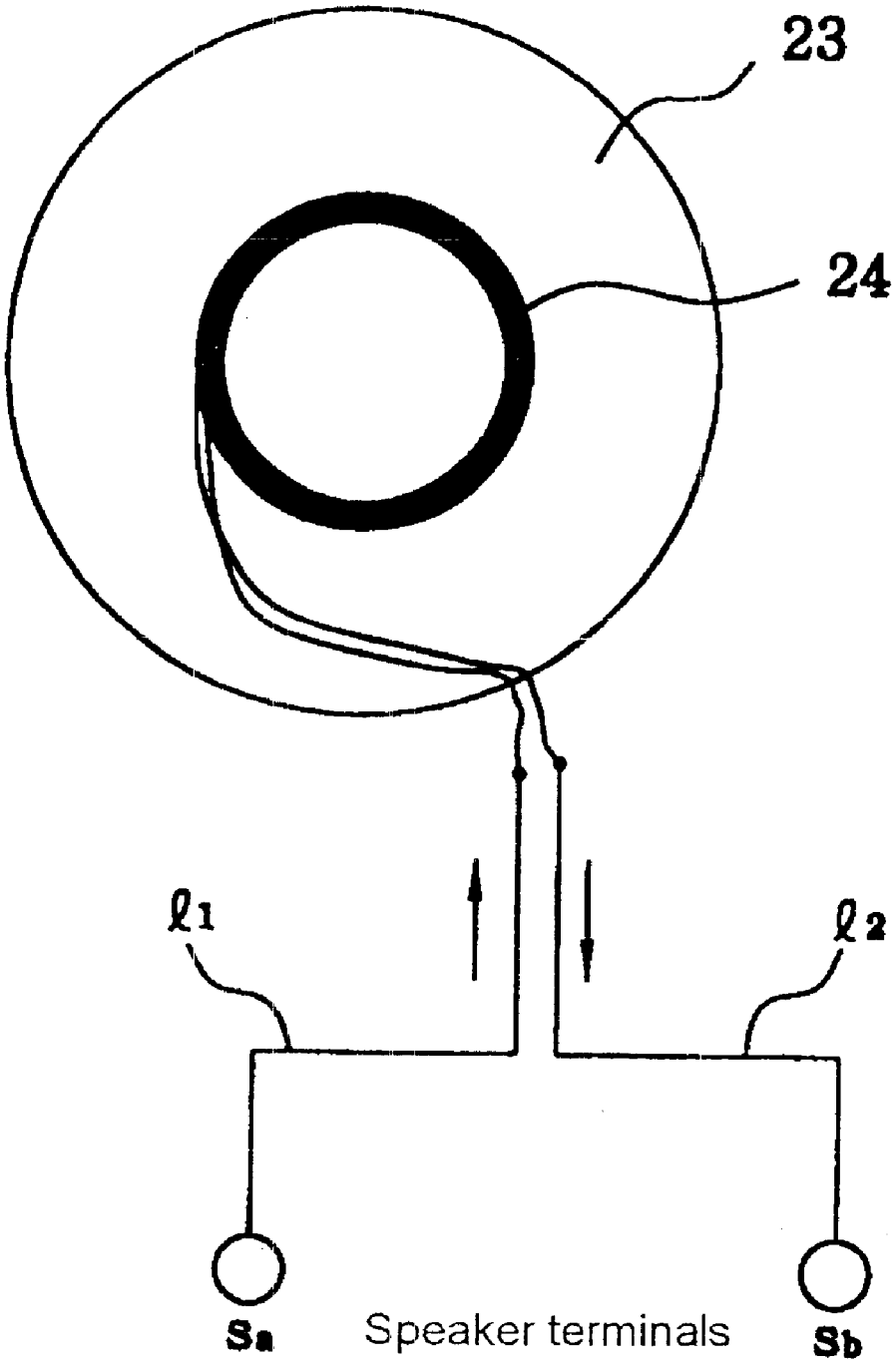
FIGS. 5*a* and 5*b* are views showing the wiring states of the combined receiver and speaker in speaker and receiver modes, respectively.

FIG. 5*a* is a wiring diagram of the combined receiver and speaker of this invention when it is used in a speaker mode. Referring to FIG. 5*a*, a lead-in wire 11 and a lead-out wire 12 are wired from the speaker terminals Sa and Sb to the coil 24, C arranged on the diaphragm 23. Therefore, a magnetic field of a predetermined direction is formed around the coil 24, C by the voice current received from the speaker terminals Sa and Sb. At this time, the sound pressure generated by the vibration at a predetermined frequency is generated by an exciting force between the magnetic field around the coil 24, C and the magnetic flux of the magnet 21.

Figure 5B:
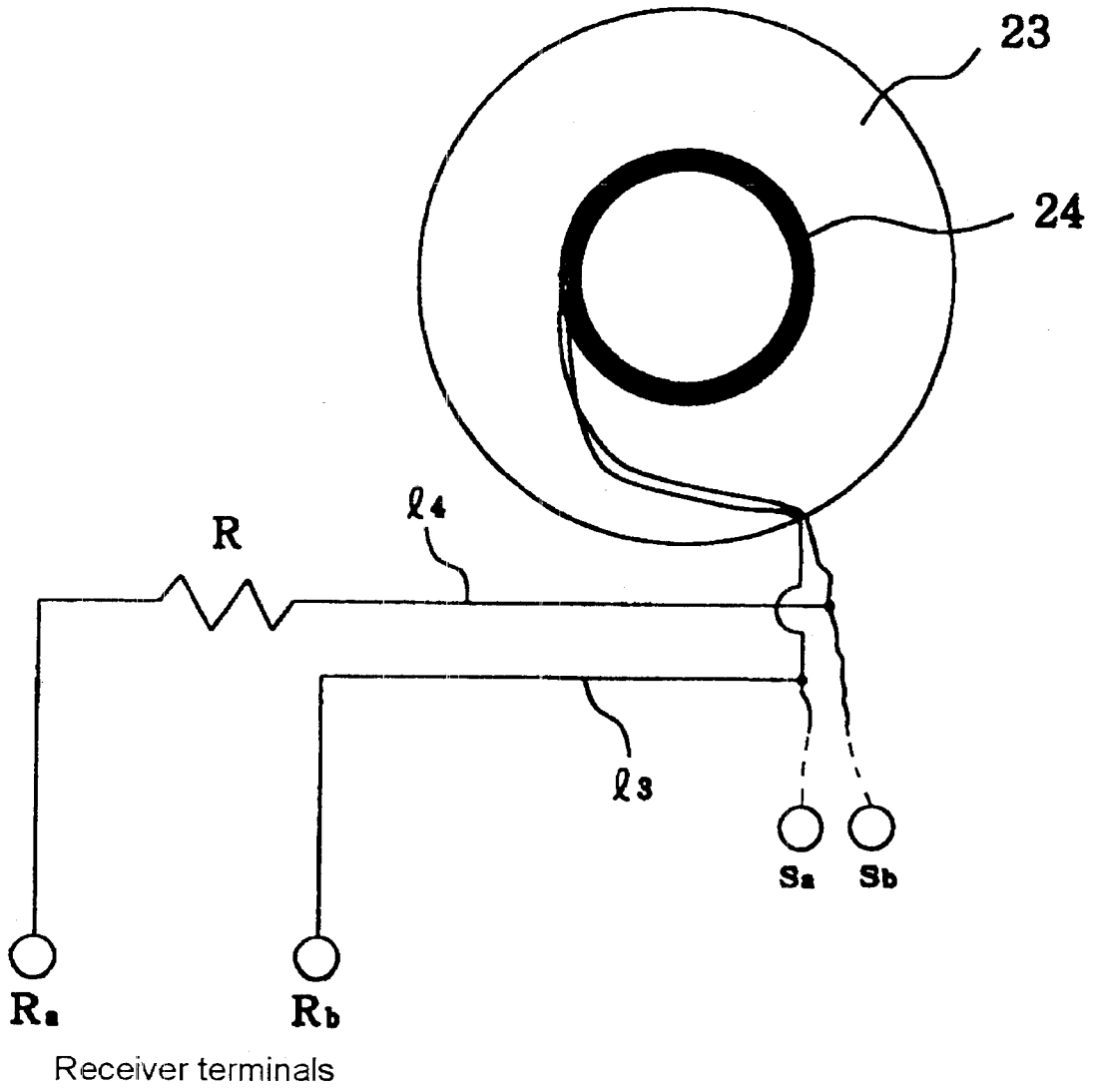

Further, FIG. 5*b* is a wiring diagram of the combined receiver and speaker when it is used in the receiver mode. Referring to FIG. 5*b*, a lead-in wire 13 and a lead-out wire 14 are wired from the receiver terminals Ra and Rb in parallel with the lead-in wire 11 and the lead-out wire 12 wired to the coil 24, C in the speaker mode. Further, the resistor 25, R is connected to the lead-out wire 14 of the receiver terminals Ra and Rb (here, the resistor 25, R can be also connected to the lead-in wire 13), such that the resistor 25, R is connected to the coil 24, C in series.

According to the present invention, a signal transmitted/received to/from a controller (not shown) of a corresponding communication terminal is processed to output a voice current to the speaker terminals Sa and Sb and the receiver terminals Ra and Rb. In this case, the voice current outputted to the speaker terminals Sa and Sb in the speaker mode is applied to the coil 24, C with a resistance value of 8Ω through the leading-in wire 11 and the lead-out wire 12 connected to the coil 24, C. Accordingly, the voice current applied from the speaker terminals Sa and Sb allows the diaphragm 23 to vibrate up and down due to a magnetic field formed by the current flowing through the coil 24, C and a magnetic field from the magnet 21 so as to generate a sound pressure of a predetermined intensity.

Further, in the receiver mode, voice current applied from the receiver terminals Ra and Rb is applied to the coil 24, C through the resistor 25, R connected to the lead-out wire 14 via the lead-in wire 11 and the lead-out wire 12 connected to the coil 24, C. The applied voice current is decreased in its intensity by the impedance of 32Ω obtained by summing the resistance value of 24Ω of the resistor 25, R and the resistance value of 80 of the coil 24, C. Therefore, the voice current applied from the receiver terminals Ra and Rb allows the diaphragm 23 to vibrate up and down due to a magnetic field formed by the current flowing through the coil 24, C via the resistor 25, R and a magnetic field linked from the magnet 21 so as to generate a sound pressure of a predetermined intensity.

The frequency of the sound pressure outputted in the speaker mode is probably higher than that of the sound pressure outputted in the receiver mode. The reason for this is that the intensity of the sound pressure varies according to the intensity of the voice current by selective connection of impedance.

The chip resistor 25, R is combined with another resistors and logic circuit, so the output of the output terminals can be varied according to the input of the input terminals. Further, the impedance can be selected by the chip resistor 25, R mounted at a portion of the frame 20, thus simplifying the construction of the combined receiver and speaker, and allowing a speaker and a receiver to be combined.

Moreover, it is preferable to form a through hole (not shown) at a portion of the frame 20 so as to maintain uniform sound pressure caused by the vibration of the diaphragm 23.

The combined receiver and speaker can be manufactured in the shape of a thin film. Further, a sound with an output level of 70 to 80 dB is preferably outputted within a range of 1 m in the speaker mode, while a sound with an output level of 100 dB is preferably outputted within a range of 10 cm in the receiver mode.

The combined receiver and speaker of the present invention provides an advantage that it can be adapted to products having comparatively narrow spaces such as a mobile communication terminal with a small size and a light weight.

As described above, the present invention provides a combined receiver and speaker, which is provided with a frame (including a yoke function), a magnet, an upper plate, a diaphragm, a voice coil and a chip resistor with the voice coil and the chip resistor connected in series, such that the impedance can be controlled by the combination of selective impedance in speaker and receiver modes, thus realizing the miniaturization and lightening of the combined receiver and speaker, easily preparing the space when adapted to the mobile communication terminals, simplifying construction, and reducing manufacturing costs of the combined receiver and speaker.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A combined receiver and speaker, comprising:

a diaphragm for generating sounds of a predetermined frequency through vibrations caused by a sound pressure in speaker and receiver modes;

a voice coil for vibrating the diaphragm using a magnetic field formed around a magnet attached to the diaphragm and generated by applied voice current; and a chip resistor for decreasing the intensity of the applied voice current;

wherein the voice current is selectively applied to the voice coil such that the voice current is applied to the voice coil from speaker terminals in speaker mode, while the voice current is applied to the voice coil via the chip resistor from receiver terminals in receiver mode.

2. The combined receiver and speaker according to claim 1, wherein the voice coil has an impedance value of 8Ω in speaker mode, and the voice coil and the chip resistor have an impedance value of 32Ω in total in receiver mode.

3. The combined receiver and speaker according to claim 1, wherein the voice coil and the chip resistor are connected in series with each other.

4. The combined receiver and speaker according to claim 1, wherein the chip resistor is arranged on a surface of a frame.

* * * * *